United States Patent [19]

Endo et al.

[11] Patent Number: 4,734,347

[45] Date of Patent: Mar. 29, 1988

[54] ELECTROPHOTOGRAPHIC PLATE HAVING A PROTECTIVE LAYER OF A FLUORINE-CONTAINING COPOLYMER

[75] Inventors: Keiichi Endo; Akira Kageyama; Yasuo Katsuya; Yasuki Mori, all of Hitachi, Japan

[73] Assignee: Hitachi Chemical Co., Ltd., Japan

[21] Appl. No.: 916,697

[22] Filed: Oct. 8, 1986

[30] Foreign Application Priority Data

Oct. 8, 1985 [JP] Japan ..... 60-224367

[51] Int. Cl.[4] ..... G03G 5/14

[52] U.S. Cl. ..... 430/66; 430/58

[58] Field of Search ..... 430/66, 67, 49, 58

[56] References Cited

U.S. PATENT DOCUMENTS

| | | | |
|---|---|---|---|
| 4,403,026 | 9/1983 | Shimizu et al. | 430/66 |
| 4,559,260 | 12/1985 | Hirooka et al. | 430/66 |
| 4,600,673 | 7/1986 | Hendrickson et al. | 430/66 |

*Primary Examiner*—John L. Goodrow

*Attorney, Agent, or Firm*—Antonelli, Terry & Wands

[57] ABSTRACT

An electrophotographic plate having a protective layer comprising a fluorine-containing copolymer having monomer units of a fluoroolefin, and an alkyl vinyl ether and/or cycloalkyl vinyl ether on an organic photoconductive layer formed on the electroconductive layer is excellent in electrophotographic properties and durability.

8 Claims, No Drawings

ELECTROPHOTOGRAPHIC PLATE HAVING A PROTECTIVE LAYER OF A FLUORINE-CONTAINING COPOLYMER

BACKGROUND OF THE INVENTION

This invention relates to an electrophotographic plate excellent in electrophotographic properties and durability.

Heretofore, inorganic photoconductive substances such as selenium, zinc oxide, titanium oxide, cadmium sulfide, etc. have mainly been used as photosensitive materials in electrophotographic materials applying photoconductive substances as photosensitive materials. But these materials are generally strongly poisonous and cause a problem in their disposal.

On the other hand, photosensitive materials using organic photoconductive compounds are generally weak in toxicity compared with the inorganic photoconductive substances and advantageous in transparency, flexibility, light weight, surface smoothness, price, etc. Thus, the use of organic photoconductive compounds has widely been studied. Above all, photosensitive materials consisting of multi-layer having separated charge generating function and charge transport function have been developed rapidly, since they can remarkably increase sensitivity which was a great defect of prior art photosensitive materials using organic photoconductive compounds.

When these photosensitive materials using organic photoconductive compounds are applied to electrophotographic equipments, for example, employing the Carlson process and subjected to repeated charging, exposing and developing (or "charge, exposure and development"), it is necessary to clean (remove) toners slightly adhered to and remaining on the surface of photosensitive material with a blade or brush. By repeating this cleaning step, the surface of photosensitive material is worn and damaged, which results in making transferred images unclear and sometimes bringing about peeling of a charge transport layer and a charge generating layer so as to shorten the life of photosensitive material remarkably.

In order to improve the durability, the formation of a protective layer consisting essentially of a polymer such as nitrocellulose, acetylnitrocellulose, polyvinylbutyral, polycarbonate, polystyrene, polyeter, polyurethane, polyamide, poly-n-tutyl methacrylate, etc., on the surface is proposed, for example in U.S. Pat. No. 4,469,771 and German Laid-Open (DE-OS) No. 2,452,622. But the prior art protective films are not sufficient in wear resistance and have a defect in that an increase in residual potential in electrophotographic properties and lowering in the sensitivity easily take place. Therefore, the development of a protective layer having high wear resistance without lowering electrophotographic properties has been desired.

SUMMARY OF THE INVENTION

It is an object of this invention to provide an electrophotographic plate excellent in electrophotographic properties and durability while using organic photoconductive compounds.

This invention provides an electrophotographic plate comprising an electroconductive layer, an organic photoconductive layer formed on the electroconductive layer, and a protective layer formed on the organic photoconductive layer, said protective layer comprising a fluorine-containing copolymer having as monomer units a fluoroolefin and an alkyl vinyl ether and/or cycloalkyl vinyl ether.

DESCRIPTION OF THE PREFERRED EMBODIMENTS

The photoconductive layer is a layer containing one or more organic photoconductive compounds. Examples of the photoconductive layer are a film of one or more organic photoconductive compounds, a film containing one or more organic photoconductive compounds and a binder, a multi-layer film comprising a charge generating layer and a charge transport layer.

As the organic photoconductive compounds, conventional ones can be used. It is preferable to use an organic pigment which generates a charge, and a charge transport material in combination as the organic photoconductive compounds. In the above-mentioned charge generating layer, one or more organic pigments generating a charge are included, and in the charge transport layer, a charge transport material is included.

As the organic pigment which is included in the charge generating layer for charge generation, there can be used azoxybenzenes, disazos, trisazos, benzimidazoles, multi-ring quinones, indigoids, quinacridones, metallic or non-metallic phthalocyanines having various crystal structures, perylenes, methines, etc., these pigments being known for charge generation. These pigments can be used alone or as a mixture thereof. These pigments are, for example, disclosed in British Pat. Nos. 1,370,197, 1,337,222, 1,337,224 and 1,402,967, U.S. Pat. Nos. 3,887,366, 3,898,084, 3,824,099 and 4,028,102, Canadian Pat. No. 1,007,095, German Offenlegungsschrift No. 2,260,540, etc. It is also possible to use all organic pigments which can generate charge carriers by illumination with light other than those mentioned above.

A part of typical examples of the organic pigments are illustrated below, but needless to say, the organic pigments are not limited thereto.

Examples of the phthalocyanine series pigments are copper phthalocyanine, metal free phthalocyanines, magnesium phthalocyanine, aluminum phthalocyanine, copper chromium phthalocyanine, copper-sulfated phthalocyanine, etc. As to their cyrstal forms, $\alpha$-form, $\beta$-form, $\gamma$-form, $\epsilon$-form, $\chi$-form, etc., may be used.

Particularly, the use of $\tau$, $\tau'$, $\eta$ and $\eta'$ type metal free phthalocyanines disclosed in European Patent Publication No. 92,255, etc. is preferable since they have sensitivity upto long wavelengths (near 800 nm).

As the charge transport material, there can be used organic high polymeric compounds such as poly-N-vinylcarbazole, halogenated poly-N-vinylcarbozole, polyvinylpyrene, polyvinylindoloquinoxalines, polyvinylbenzothiophene, polyvinylanthracene, polyvinylacridine, polyvinylpyrazoline, etc.; organic low-molecular weight compounds such as fluorenone, fluorene, 2,7-dinitro-9-fluorenone, 4H-indeno(1,2,6)thiophen-4-one, 3,7-dinitro-dibenzothiophen-5-oxide, 1-bromopyrene, 2phenylpyrene, carbazole, 3-phenylcarbazole, 2-phenylindole, 2-phenylnaphthalene, oxadiazole, 1-phenyl-3-(4-diethyl-aminostyryl)-5-(4-diethylaminophenyl)pyrazoline, 2-(p-dimethylaminophenyl)-4-(p-diethylaminophenyl)-5-(o-chlorophenyl)-1,3-oxazole, imidazole, chrysene, tetraphene, acridene, triphenylamine, and derivatives thereof. These compounds can be used alone or as a mixture thereof.

When an organic pigment generating a charge and a charge transport material are used in admixture, it is preferable to use organic pigment/charge transport material in a weight ratio of 10/1 to 2/1. When a high polymeric compound is used as the charge transport material, it is not necessary to use a binder, but a binder may be used in an amount of 500% by weight or less based on the total weight of an organic component and a charge transport material. When a low-molecular weight compound is used as the charge transport material, a binder is used preferably in an amount of 30% to 500% by weight or less based on the total weight of an organic component and a charge transport material.

When the binder is used, it is possible to add one or more additives such as plasticizers, fluidity imparting agents, pin hole inhibitors, etc. depending on the necessity.

As the binder, there can be used silicone resins, polyamide resins, polyurethane resins, polyester resins, epoxy resins, polyketone resins, polycarbonate resins, polystyrene resins, poly(methyl methacrylate) resins, polyarylamide resins, etc. It is also possible to use thermosetting type resins and/or light curable type resins which are crosslinked by heat and/or light. There is no limitation to resins, so long as they have insulating properties and are able to form a film at ordinary state and cured by heat and/or light to form a film.

As the plasticizer, there can be used halogenated paraffins, dimethylnaphthalene, dibutyl phthalate, etc.

As the fluidity imparting agents, there can be used Modaflow (a trade name mfd. by Monsanto Chemical Co.), Acronal 4F (a trade name mfd. by BASF AG), etc.

As the pin hole inhibitor, there can be used benzoin, dimethyl phthalate, etc.

These additives are used depending on purposes and in amounts sufficient to exhibit their effects.

When the photoconductive multi-layer comprising a charge generating layer and a charge transport layer is formed, the above-mentioned organic pigment which generates charge is included in the charge generating layer and the above-mentioned binder is included in an amount of 500% by weight or less based on the weight of organic pigment, and the above-mentioned other additives may be added in an amount of 5% by weight or less based on the weight of the organic pigment. The charge transfer layer contains the above-mentioned charge transfer material. It may further contain the above-mentioned binder in an amount of 500% by weight or less based on the weight of the charge transport material. When the charge transport material is a low-molecular weight compound, it is preferable to contain 50% by weight or more of the binder based on the weight of said compound. The charge transfer layer may contain the above-mentioned additives in an amount of 5% by weight or less based on the weight of the charge transport material.

The fluorine-containing copolymer contained in the protective layer is a copolymer obtained by copolymerization of a fluoroolefin such as chlorotrifluoroethylene, trifluoroethylene, tetrafluoroethylene, etc., or a mixture thereof; an alkyl vinyl ether such as ethyl vinyl ether, propyl vinyl ether, butyl vinyl ether, hexyl vinyl ether, etc., or a mixture thereof; and/or a cycloalkyl vinyl ether such as cyclohexyl vinyl ether, etc.

The fluorine-containing copolymer may contain as copolymer components hydroxylalkyl vinyl ethers such as hydroxyethyl vinyl ether, hydroxypropyl vinyl ether, hydroxybutyl vinyl ether, etc.; carboxyalkyl vinyl ethers such as carboxyethyl vinyl ether, etc.; ethylene, propylene, isobutylene, vinyl chloride, vinylidene chloride, vinyl acetate, vinyl n-butyrate, methyl methacrylate, methacrylic acid, acrylic acid, etc.

In the copolymer, the fluoroolefin unit is preferably contained in an amount of 40 to 60% by mole based on the total amounts of monomer units.

Further, the content of the alkyl vinyl ether and cycloalkyl vinyl ether unit in the copolymer is preferably 5 to 60% by mole based on the total amounts of monomer units (other components being used so as to make the total 100% by mole). If the amount is too small, the copolymer is difficult to be dissolved in an organic solvent and the formation of the layer becomes difficult.

Moreover, the above-mentioned hydroxyalkyl vinyl ether and carboxyalkyl vinyl ether may preferably contained in an amount of preferably 30% by mole or less, more preferably 15% by mole or less, based on the total amounts of monomer units. If the amount is too much, the solubility in an organic solvent becomes poor.

It is preferable to use the fluorine-containing copolymer having a weight average molecular weight of 5,000 to 150,000 (calculated in terms of standard polystyrene using liquid chromatography). When the molecular weight is too small, the strength of film is lowered, whereas when the molecular weight is too large, the viscosity of a solution obtained by dissolving in an organic solvent becomes too high to form the desirable protective layer.

The fluorine-containing copolymer is soluble in an organic solvent such as xylenes, toluene, butyl acetate, methyl isobutyl ketone, etc., unlike poly(fluorinated ethylene), so that the protective layer can easily be formed.

The protective layer may contain a silicone resin, a poly(methyl methacrylate) resin, an epoxy resin, a polycarbonate resin, a polyester resin, a polystyrene resin, etc. in an amount of preferably 100% by weight or less based on the weight of the fluorine-containing copolymer, particularly preferably 60% by weight or less based on the weight of the fluorine-containing copolymer in combination with the fluorine-containing copolymer. When the amount of these resins is too much, the effect of using the fluorine-containing copolymer is lowered.

The protective layer may contain various additives which can be used in the photoconductive layer in amounts depending on purposes.

As the electroconductive layer, there can be used paper subjected to electroconductive treatment, plastic films, plastic films subjected to electroconductive treatment laminated with metal foils such as aluminum foil, metal plates, and the like.

The electrophotographic plate can be produced by forming the organic photoconductive layer on the electroconductive layer, and forming the protective layer on the photoconductive layer. The thickness of the photoconductive layer is preferably 5 to 50 μm. When the photoconductive multi-layer comprising the charge generating layer and the charge transport layer is used, the thickness of the charge generating layer is preferably 0.001 to 10 μm, more preferably 0.2 to 5 μm. If the thickness is less than 0.001 μm, there is a tendency that the uniform formation of the charge generating layer becomes difficult, whereas if the thickness is more than 10 μm, there is a tendency to lower electrophotographic properties. The thickness of the charge transport layer is preferably 5 to 50 μm, more preferably 8 to 20 μm. If the thickness is less than 5 μm, there is a tendency that the initial potential becomes low, whereas if the thickness is more than 50 μm, there is a tendency to lower the sensitivity.

The thickness of the protective layer is preferably 0.01 to 10 μm, more preferably 0.1 to 5 μm. If the thickness is less than 0.01 μm, there is a tendency that the effect as the protective layer is lowered and the durability becomes poor, whereas if the thickness is more than 5 μm, there is a tendency that the sensitivity is lowered and the residual potential increases.

The formation of the photoconductive layer on the electroconductive layer can be carried out by a process of vapor deposition of the organic photoconductive compound on the electroconductive layer, a process for coating a solution or dispersion of the organic photoconductive compound and other components in an organic solvent uniformly on the electroconductive layer, followed by drying, and the like. As the organic solvent, there can be used ketone series solvents such as acetone, methyl ethyl ketone, etc.; ether series solvents such as tetrahydrofuran, etc.; aromatic series solvents such as toluene, xylenes, etc.; halogenated hydrocarbon series solvents such as methylene chloride, carbon tetrachloride, etc.; alcohol series solvents such as methanol, ethanol, propanol, etc.

The formation of the charge generating layer and the charge transport layer can be carried out in the same manner as mentioned above. In such a case, either the charge generating layer or the charge trasnpsort layer may be formed as an upper layer or the charge generating layer may be sandwiched between two charge transport layers.

The protective layer can be formed in the same manner as employed for forming the photoconductive layer by the coating and drying process.

The electrophotographic plate may contain a thin adhesive layer or a barrier layer immediately above the electroconductive layer.

This invention is illustrated by way of the following Examples, wherein the following materials are used.

(1) Organic pigments for generating charge:

Phthalocyanines: τ type metal free phthalocyanine ($H_2PC$)

(2) Charge transport material:

Oxazole derivatives: 2-(p-dimethylaminophenyl)-4-(p-dimethylaminophenyl)-5-(o-chlorophenyl)-1,3-oxazole (OXZ)

(3) Binder

Polyester resin: Vylon 200 (V-200) (a trademark, mfd. by Toyobo Co., Ltd.)

Silicone vanish: KR-255 (a trade name, mfd. by Shinetsu Chemical Industry Co., Ltd.)

Fluorine-containing copolymer: LUMIFULON LF-100 (LF 100) (a trade name, mfd. by Asahi Glass Co., Ltd.)

This is a copolymer of chlorotrifluoroethylene (about 50% by mole), hydroxyalkyl vinyl ether and alkyl vinyl ether having a weight-average molecular weight of 20,000 to 25,000, a hydroxyl value of 52 and an acid value of 0. This copolymer is dissolved in a mixed solvent of xylene and methyl isobutyl ketone with the solid content of 50% by weight.

Fluorine-containing copolymer A (Copolymer A):

This is a copolymer of ethyl vinyl ether (18.3% by mole), cyclohexyl vinyl ether (21.7% by mole), 4-hydroxybutyl vinyl ether (8.5% by mole), 4-carboxybutyl vinyl ether (0.9% by mole), and chlorotrifluoroethylene (50.6% by mole) having a weight average molecular weight of 50,000 to 70,000, a hydroxyl value of 47 and an acid value of 5. This copolymer is dissolved in a mixed solvent of xylene and methyl isobutyl ketone with the solid content of 50% by weight.

COMPARATIVE EXAMPLE 1

A mixed solution of 2.0 g of $H_2PC$, 2.0 g of KR-255 and 80 g of methanol was kneaded in a ball mill (a pot having a diameter of 10 cm mfd. by Nippon Kagaku Togyo Co., Ltd.) for 8 hours. The resulting dispersion was coated on an aluminum plate (the electroconductive layer) by using an applicator, and dried at 100° C. for 1 hour to form a charge generating layer having a thickness of about 1 μm.

Then, 10 g of OXZ and 10 g of Vylon 200 were completely dissolved in 80 g of tetrahydrofuran. The resulting solution was coated on the charge generating layer by using an applicator, and dried at 90° C. for 20 minutes to form a charge transport layer.

The thus produced electrophotographic plate had no protective layer.

EXAMPLES 1 to 4

The process of Comparative Example 1 was repeated to form the charge generating layer and the charge transport layer on the electroconductive layer. Then, LF100 or copolymer A was diluted with methyl ethyl ketone so as to make the solid content 5 to 20% by weight. The resulting solution was coated on the charge transport layer by using an applicator, cured with heating at 120° C. for 1 hour to give a protective layer having the thickness as shown in Table 1.

The thus produced electrophotographic plates were subjected to the measurement of electrophotographic properties by using an electrostatic recording paper analyzer (SP-428 mfd. by Kawaguchi Electric Works, Co., Ltd., Japan). The results are shown in Table 1.

In Table 1, the initial potential $V_o$ (V) shows a charge potential at the time of electrical discharge of 5 kV corona for 10 seconds in the dynamic measurement, the dark decay ($V_k$) shows a potential decreasing rate after allowed to stand for 30 seconds in the dark from the measurement of $V_o$, and the half decay exposure ($E_{50}$) shows a light amount value until the potential becomes a half when illuminated with a white light of 10 lx. The spectral light-sensitivity at 800 nm (S800) is a reciprocal value of the product of the time t (sec) by the energy of illuminated light (mW/m$^2$), wherein the time t means a time required for making the potential half after illumination of light separated into a monochromatic light of 800 nm through a monochrometer using a halogen lamp as a light source.

Further, wear resistance is evaluated by the number of sliding of gauze until the fiber marks are admitted by the naked eye on the surface of an electrophotographic plate using a wear tester (mfd. by Suga Test Instruments) and also listed in Table 1.

TABLE 1

| Example No. | Protective layer Material | Film thickness (μm) | Electrophotographic properties $V_o$ (V) | $V_k$ (%) | E50 (1x · s) | S800 ($m^2$/mJ) | Wear resistance (times) |
|---|---|---|---|---|---|---|---|
| Comparative Example 1 | — | — | 830 | 75 | 1.5 | 0.02 | 100 |
| Example 1 | LF100 | 0.5 | 960 | 81 | 1.6 | 0.20 | 7000 |
| Example 2 | LF100 | 1.0 | 960 | 84 | 1.6 | 0.20 | 14000 |
| Example 3 | Copolymer A | 1.0 | 970 | 85 | 1.6 | 0.20 | 14000 |
| Example 4 | Copolymer A | 2.0 | 980 | 86 | 1.9 | 0.19 | 14000 |

As mentioned above, the electrophotographic plate of this invention is excellent in electrophotographic properties, good in the dark decay and has high sensitivity. If necessary, it is possible to apply to a laser beam printer (LBP) mounting a diode laser having an oscillation wavelength in the near infrared region due to having high spectral light-sensitivity at 800 nm. Further, the electrophotographic plate of this invention has remarkably high wear resistance.

Thus, the electrophotographic plate of this invention is excellent in electrophotographic properties and durability.

What is claimed is:

1. An electrophotographic plate comprising an electroconductive layer, an organic photoconductive layer formed on the electroconductive layer, and a protective layer formed on the organic photoconductive layer, said protective layer comprising a fluorine-containing copolymer having as monomer units a fluoroolefin and at least one of an alkyl vinyl ether and a cycloalkyl vinyl ether.

2. An electrophotographic plate according to claim 1, wherein the organic photoconductive layer is a multilayer comprising a charge generating layer and a charge transport layer.

3. An electrophotographic plate according to claim 1, wherein the fluorine-containing copolymer comprises 40 to 60% by mole of the total monomer units of fluoroolefin and 5 to 60% by mole of the monomer units of alkyl vinyl ether and cycloalkyl vinyl ether.

4. An electrophotographic plate according to claim 1, wherein the fluorine-containing copolymer has a weight average molecular weight of 5000 to 150,000.

5. An electrophotographic plate according to claim 1, wherein the fluoroolefin is chlorotrifluoroethylene, trifluoroethylene, tetrafluoroethylene, or a mixture thereof; the alkyl vinyl ether is ethyl vinyl ether, propyl vinyl ether, butyl vinyl ether, hexyl vinyl ether, or a mixture thereof; and the cycloalkyl vinyl ether is cyclohexyl vinyl ether.

6. An electrophotographic plate according to claim 2, wherein the fluorine-containing copolymer comprises 40 to 60% by mole of the total monomer units of fluoroolefin and 5 to 60% by mole of the monomer units of alkyl vinyl ether and cycloalkyl vinyl ether.

7. An electrophotographic plate according to claim 2, wherein the fluorine-containing copolymer has a weight average molecular weight of 5000 to 150,000.

8. An electrophotographic plate according to claim 2, wherein the fluoroolefin is chlorotrifluoroethylene, trifluoroethylene, tetrafluoroethylene, or a mixture thereof; the alkyl vinyl ether is ethyl vinyl ether, propyl vinyl ether, butyl vinyl ether, hexyl vinyl ether, or a mixture thereof; and the cycloalkyl vinyl ether is cyclohexyl vinyl ether.

* * * * *